United States Patent [19]

Hart et al.

[11] Patent Number: 4,511,342

[45] Date of Patent: Apr. 16, 1985

[54] WINDING AND LAUNCHING DEVICE FOR TOY VEHICLES

[75] Inventors: William Hart, Palos Verdes Estates; Michael T. McKittrick, Jr., Torrance, both of Calif.

[73] Assignee: Mattel, Inc., Hawthorne, Calif.

[21] Appl. No.: 524,513

[22] Filed: Aug. 19, 1983

[51] Int. Cl.[3] ..... A63H 29/00

[52] U.S. Cl. ..... 446/429; 446/435; 446/249

[58] Field of Search ..... 446/429, 430, 246, 247, 446/248, 435

[56] References Cited

U.S. PATENT DOCUMENTS

| | | | |
|---|---|---|---|
| 3,886,682 | 6/1975 | Ieda et al. | 446/429 |
| 4,286,406 | 9/1981 | Sims et al. | 446/246 |
| 4,292,756 | 10/1981 | Jaworski et al. | 446/246 |
| 4,363,186 | 12/1982 | Goldfarb et al. | 446/429 |
| 4,433,504 | 2/1984 | Terui | 446/429 |

*Primary Examiner*—Robert A. Hafer
*Assistant Examiner*—Daniel Nolan
*Attorney, Agent, or Firm*—Reagin & King

[57] ABSTRACT

A winding and launching device for toy vehicles which includes a base covered by a shell, the shell having a shaft projecting therefrom and being adapted to mate with a coupling on a flywheel-driven toy vehicle for rotating the flywheel. The shaft is rotated at high speed through a step-up gearing arrangement by a crank positioned on the shell. A button protrudes from the shell and is connected to a platform which holds the shaft in place, depressing the button pulls the shaft from the vehicle coupling so that the vehicle may speed away.

1 Claim, 6 Drawing Figures

WINDING AND LAUNCHING DEVICE FOR TOY VEHICLES

TECHNICAL FIELD

This invention relates to toys and, more particularly, to a winding and launching device for toy vehicles.

BACKGROUND ART

Toy vehicles have long been prized by children and have helped children pass a generous number of pleasing hours during their childhood. There have been many kinds of toy vehicles and a great number of these have been wind-up toys. Wind-up toy vehicles, in general, utilize a spring wound motor to drive a set of wheels and thereby impel the vehicle over the ground. There have also been a number of flywheel driven toy vehicles which, essentially, utilize a spinning flywheel or inertia motor to provide the power to move a set of wheels and drive the vehicle over the ground. In either case, power must be provided to the vehicle by some sort of turning mechanism which either winds the spring motor or provides motion to the flywheel.

In the case of a spring motor driven vehicle, power is usually provided by use of a winding key which protrudes through the external portion of the vehicle. With a flywheel driven vehicle, it is difficult to use an external key because the flywheel must be turned quite rapidly, in most cases, to store inertia; and the vehicle must be placed on the ground as quickly as possible in order for the inertia of the flywheel to be utilized without a substantial loss of power. In many cases this problem has been, to some extent, overcome by connecting the wheels of the vehicle directly to the flywheel through a set of step-up gears. If the vehicle is pushed quite rapidly over the ground, the flywheel is set in motion. However, the optimum step-up gearing arrangement to allow the flywheel to run for any substantial period is too great to allow this method of application of power if the vehicle is to run for a substantial period of time.

Various launching systems have therefore been devised to impart motion to the toy vehicles. Examples of such prior art vehicles and launching systems are shown in the following United States patents:

- U.S. Pat. No. 2,050,892 L. Marx—Aug. 11, 1936
- U.S. Pat. No. 2,731,765 R. N. Carver—Jan. 24, 1956
- U.S. Pat. No. 3,707,805 G. H. Buck—Jan. 2, 1973
- U.S. Pat. No. 3,735,525 M. J. Freed—May 29, 1973
- U.S. Pat. No. 3,789,538 D. E. Spengler, et al—Feb. 5, 1974
- U.S. Pat. No. 3,803,756 N. S. Strongin—Apr. 16, 1974
- U.S. Pat. No. 3,886,682 M. Ieda, et al—June 3, 1975
- U.S. Pat. No. 3,959,920 M. Ieda, et al—June 1, 1976
- U.S. Pat. No. 4,087,935 R. C. Edmission, et al—May 9, 1978

None of this prior art discloses a means for rapidly imparting extremely high speeds to a flywheel driven toy vehicle so that the vehicle will operate for long periods.

DISCLOSURE OF THE INVENTION

The present invention provides a launching and winding device which is adapted to be utilized to energize a flywheel driven vehicle so that the flywheel rotates at an extremely high speed thereby imparting substantial inertia to the vehicle so that its movement will continue for a long period. The arrangement utilizes an elevatable platform having a coupling mechanism adapted to engage the coupling portion of the flywheel driving mechanism on the vehicle. The vehicle chasis sits on the platform with the coupling mechanism engaged and the vehicle wheels elevated. The arrangement has a crank positioned to turn the coupling mechanism through a set of step-up gears. The arrangement also provides a release by which the platform and the coupling to the flywheel of the vehicle may be removed essentially instantaneously leaving the vehicle with its flywheel rotating and its wheels turning on a portion of the launcher or booster which amounts to an initial portion of a road over which the vehicle is to progress.

By this unique arrangement, essentially no time is lost between the imparting of power to the flywheel and the release of the vehicle. Furthermore, the extremely high step-up ratio of the gearing arrangement which drives the take-off coupling allows the flywheel to be spun at an extremely rapid rate thereby imparting a very high inertia to the flywheel so that the vehicle runs for a long period of time.

BEST MODE FOR CARRYING OUT THE INVENTION

Figure 1:
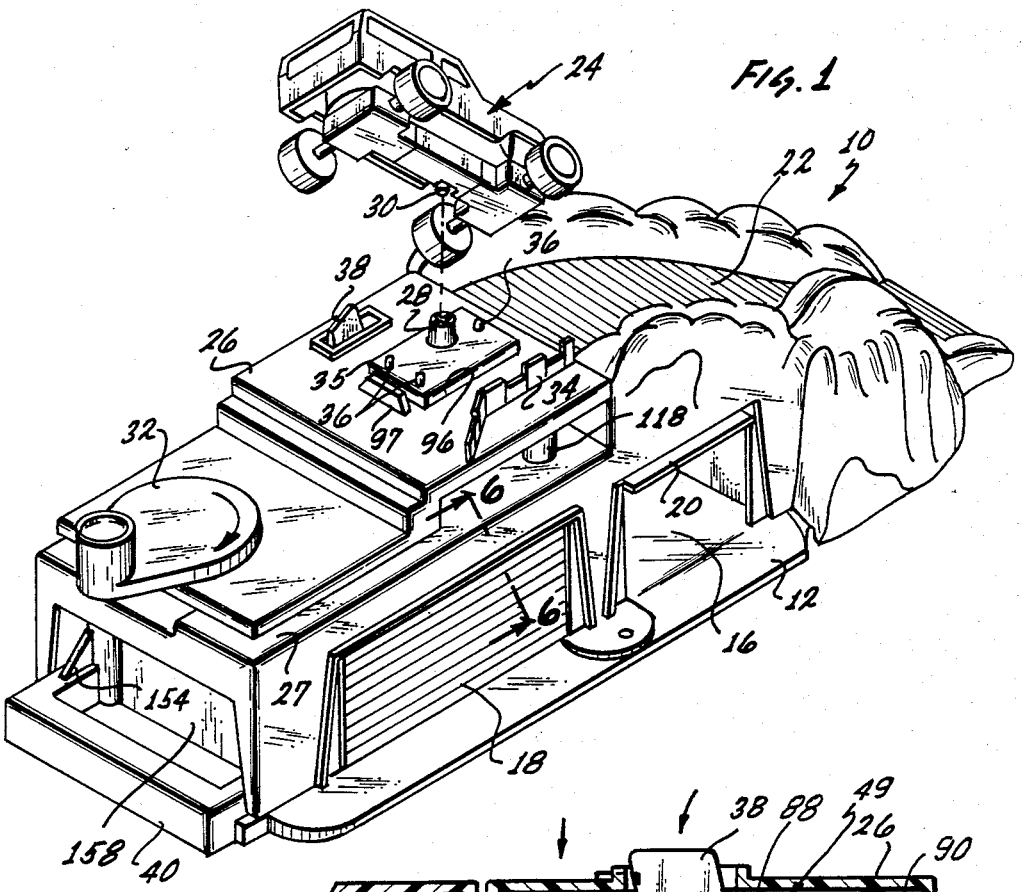
FIG. 1 is a perspective view of a winding and launching device constructed in accordance with the present invention associated with a vehicle to be driven thereby.

Referring now to the drawings and, more particularly, to FIG. 1, there is shown in perspective view a winding and launching device 10 constructed in accordance with the present invention. The device 10 includes a base 12 to which is affixed a shell 14 housing a simulated garage 16 having a pair of doors 18 and 20 opening to the exterior. The upper portion of shell 14 is provided with a roadway 22 for a vehicle 24 which may be of a four-wheel drive type such as that disclosed in copending application Ser. No. 455,686, filed Jan 5, 1983, and assigned to the assignee hereof. At the upper end of the roadway 22 is a stand 26 affixed to the roof portion 27 of garage 16 and in the center of which is found a coupling mechanism or shaft 28 having a slotted interior adapted to mate with a coupling 30 on the underside of the vehicle 24. The coupling 30 is connected by an arrangement (not shown) to provide power to a flywheel which drives the wheels of the vehicle 24 thereby causing the vehicle 24 to move. The vehicle 24 has a step-up ratio from the flywheel to the wheels making it difficult to activate the flywheel by moving the vehicle 24 over the ground.

A crank 32 is provided on the upper surface of the shell 14 and when rotated in the direction of the arrow shown in FIG. 1 causes the shaft 28 to revolve about its axis through a gearing arrangement (not shown in FIG.

1). A simulated fence 34 is provided on stand 26 and is adapted to guide vehicle 24 onto roadway 22. The shaft 28 projects from the center of a platform 35 which has three posts 36 which are adapted to engage the ends of the chassis on vehicle 24 and hold it in place while the shaft 28 is being rotated.

A button 38 projects from the upper surface of the stand 26. If this button 38 is depressed, the platform 35 and the shaft 28 are lowered into the interior of the shell 14 below the surface of the stand 26 and away from the vehicle 24. Lowering platform 35 and shaft 28 releases the vehicle 24 so that it may proceed down the roadway 22. As will be hereinafter described, the crank 32 may be connected to the shaft 28 through a step-up gearing arrangement to provide substantial inertia to the flywheel (not shown) within the vehicle 24. When the flywheel is rotating at a proper speed, the button 38 is depressed, lowering platform 35 and shaft 28 from the vehicle 24, so that it immediately progresses forward without any loss in time or inertia.

Figure 5:
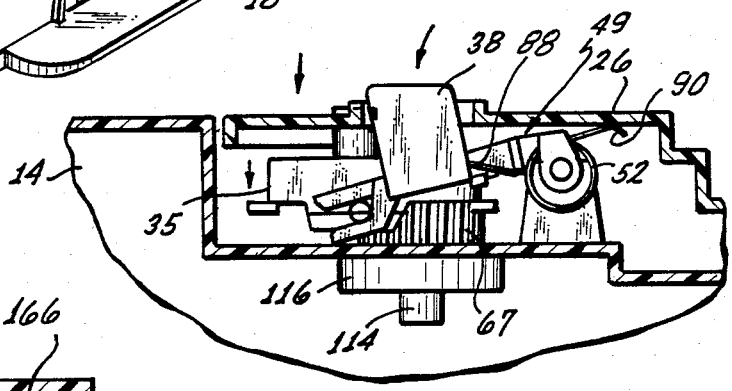
FIG. 5 is an enlarged cross section of a detail of the internal mechanism of the device shown in FIG. 1.

The arrangement by which the platform 35 and the shaft 28 are lowered will now be described in connection with FIGS. 2, 3 and 5 whereon button 38 is shown connected to an arm 48 which is part of a wishbone or yoke 49 having a second arm 80 and a bite portion 82. Each of the arms 48, 80 has a U-shaped slot 84 at its free end and a pivot pin 50 at its juncture with bite portion 82. A spring 52 encircles the pivot pin on arm 48 between bite portion 82 and a spring stop 86. Spring 52 has a first arm 88 which presses against a lower surface of the stand 26 and a second arm 90 which is trapped between a pair of projections 92, 94 on arm 48 to provide a force for raising the platform 35 slightly above an opening 96 in stand 26 when pressure is released from the button 38. The bite end of yoke 49 may be swingably connected to roof portion 27 by mounting each pin 50 to an associated one of a pair of journals 98 upstanding from roof portion 27. Each U-shaped slot or fork 84 is journalled on an associated one of a pair of pins 56 each of which is connected to the platform 35 intermediate its ends so that, when the arms 48, 80 pivot downwardly about the pins 50, the platform 35 is forced downwardly.

Figure 2:
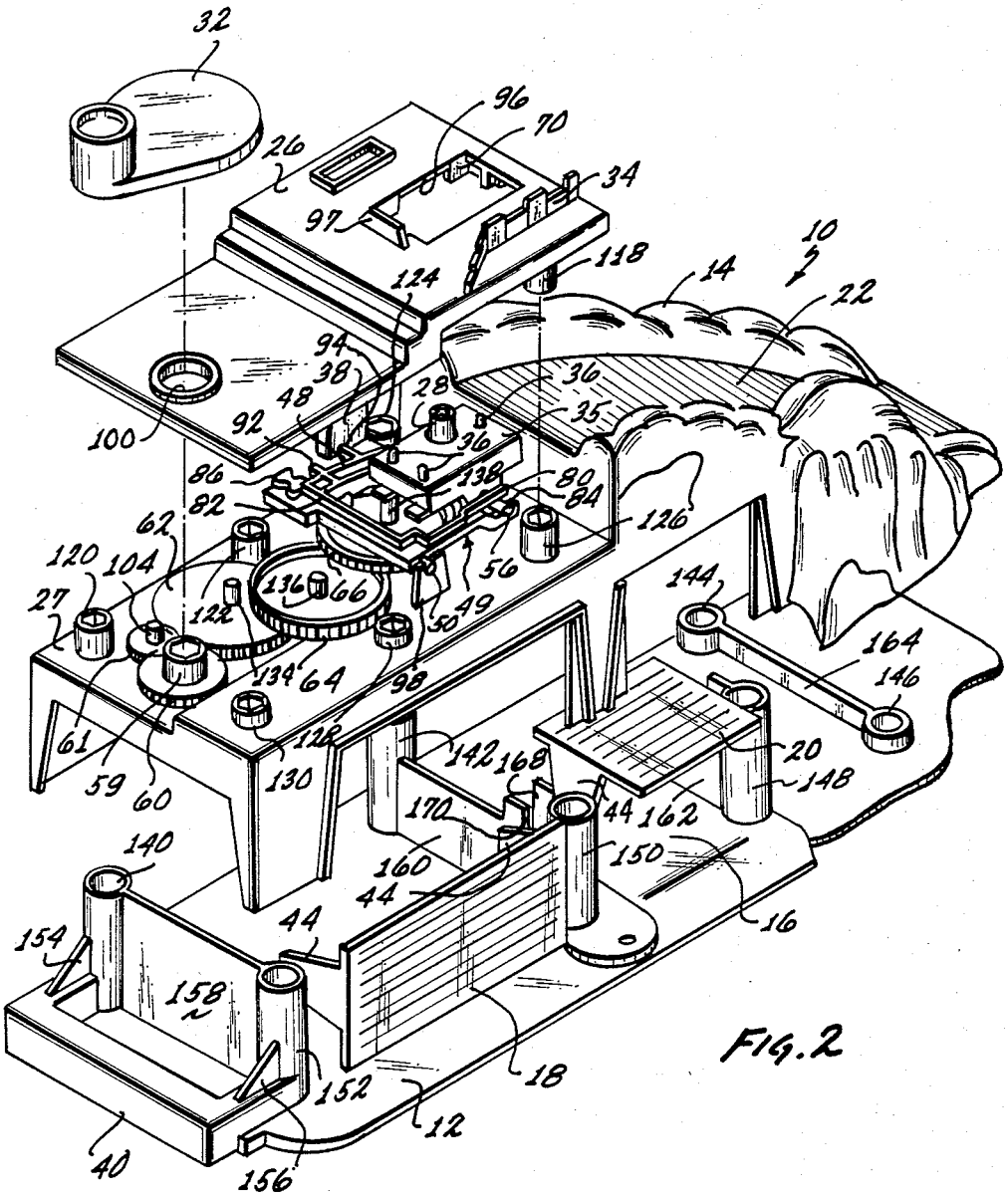
FIG. 2 is an exploded perspective view of the device shown in FIG. 1.

As best seen in FIGS. 1 and 2, an upstanding stop member 97 is provided on stand 26 adjacent one end of opening 96 to support the rear end of vehicle 24. Since the rear end of vehicle 24 is heavier than the front end, platform 35 tends to rotate on pins 56 until the vehicle engages stop member 97. When platform 35 is lowered, vehicle 24 will be driven off of stand 26 by its front wheels. The platform 36 has a plurality of stops 54 projecting therefrom which are adapted to contact the lower side of the stand 26 in the upward position of platform 35 thereby limiting its upward movement in opening 96 in the stand 26.

Figure 3:
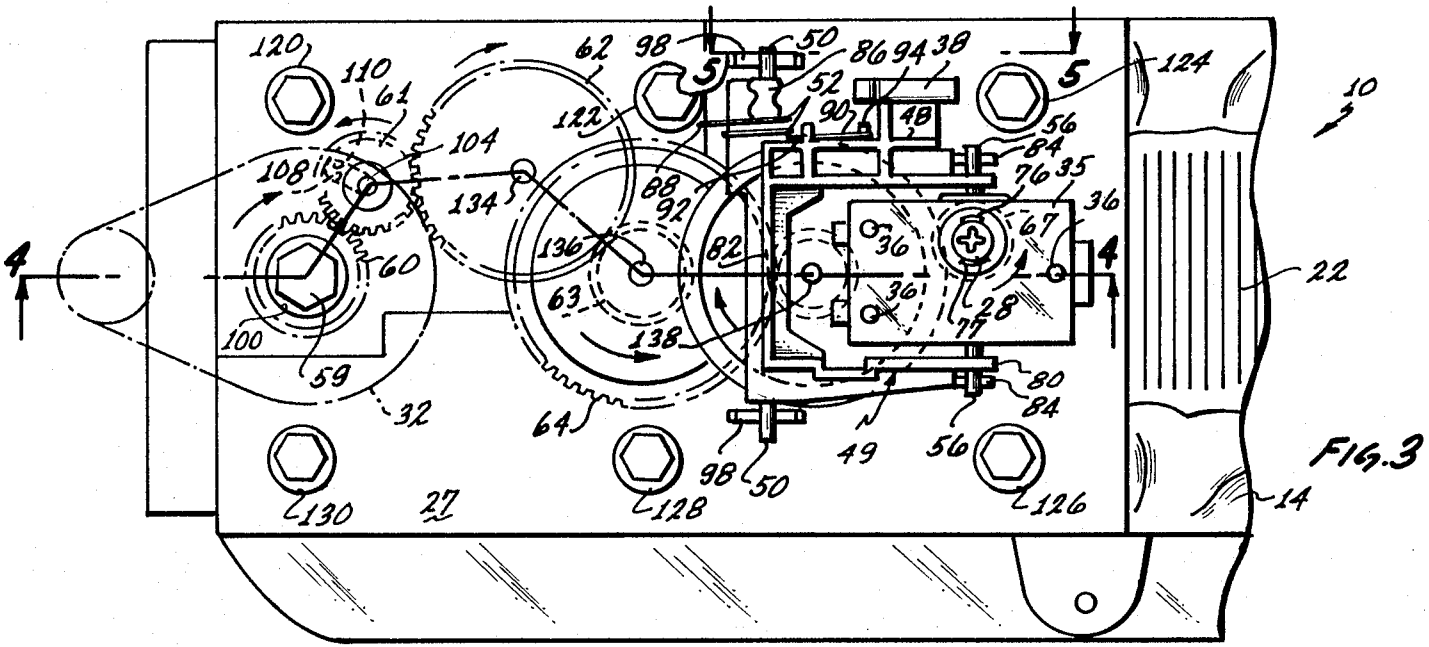
FIG. 3 is an enlarged top view of a portion of the device shown in FIG. 1.
Figure 4:
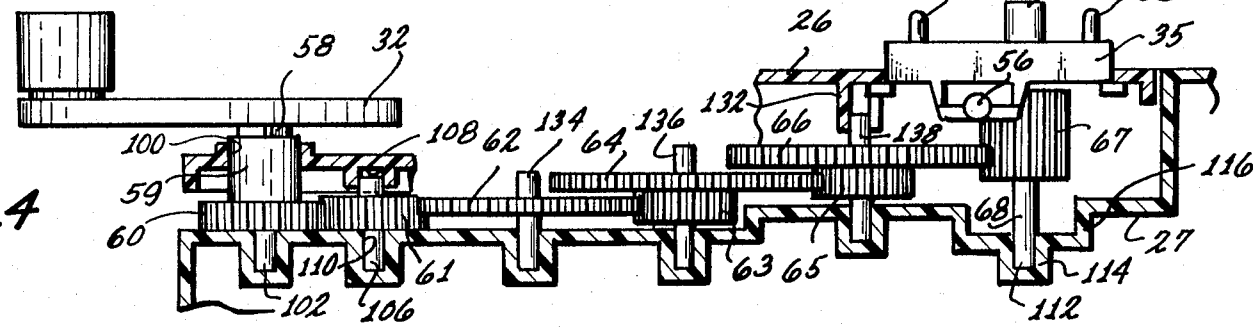
FIG. 4 is an enlarged side view of the internal mechanism utilized in the device shown in FIG. 1.

Referring now to FIGS. 2, 3 and 4, crank 32 is included in a gearing arrangement by which power may be provided to the shaft 28. Crank 32 has a hexagonal extension 58 (FIG. 4) at the lower portion thereof adapted to mate with and rotate a hexagonal socket 59 rotatably mounted in an aperture 100 in stand 26 and formed integrally with a gear 60 having a spindle 102 (FIG. 4) journalled in roof 27. The gear 60 rotates an idler gear 61 having upper and lower spindles 104, 106 journalled in arcuate slots 108, 110, respectively, so that gear 61 will idle when crank 32 is rotated counterclockwise (as view in FIG. 3) and will drive a large-diameter gear 62 when crank 32 is rotated clockwise. The gear 62 rotates a small-diameter or pinion gear 63 to drive a large-diameter gear 64 connected thereto and rotating on the same axis. The gear 64 drives a small-diameter gear 65 to rotate a large-diameter gear 66 connected thereto and rotating on the same axis as gear 65. The gear 66 ultimately drives an elongated pinion gear 67 which carries shaft 28. Pinion 67 is rotatably and reciprocably mounted on a spindle 68 having its lower end 112 firmly anchored in a non-circular bore 114 provided in roof 27 below a circular cavity 116 adapted to receive pinion 67 in its lower-most position. The shaft 28 and pinion 67 are coupled to platform 35 by a pair of ridges 76 and 77 (FIG. 3) extending outwardly from shaft 28. Thus, shaft 28 and pinion 67 move up and down with platform 35.

As will be obvious to those skilled in the art, there is a substantial step-up from the crank 32 to the gear 67 so that one rotation of the crank 32 will drive the shaft 28 through a great number of rotations. Thus, the crank 32 may be rotated rapidly and imparts very high speed rotation to the shaft 28. As the shaft 28 is directly coupled to the coupling 30 of the vehicle 24, very high speed rotation may be provided for the flywheel of the vehicle 24. Such high speed rotation allows the vehicle 24 to move quite rapidly and for an extremely long period of time compared to prior art flywheel driven vehicles.

It should be noted in FIG. 2 that the opening 96 through which the platform 35 fits in the stand 26 has a portion 70 extended downwardly in order to maintain the upright position of the platform 35 while it is being lowered in the stand 26. Stand 26 carries a plurality of depending posts, like the one shown at 118 in FIG. 2, which are adapted to engage hollow bosses 120, 122, 124, 126, 128 and 130, which are provided on roof 27 for connecting stand 26 thereto. Stand 26 also carries a plurality of depending hollow bosses, like the one shown at 132 in FIG. 4, for rotatably receiving the upper ends of spindles 134, 136 and 138 carried by gears 62, 64 and 66, respectively.

It may be further noted that a carrying handle 40 is affixed to one end of base 12.

Figure 6:
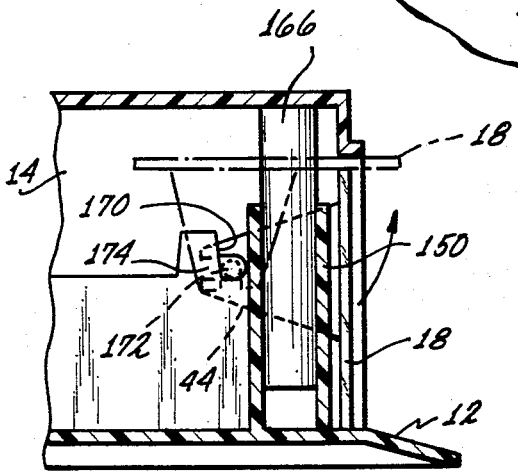
FIG. 6 is an enlarged cross section taken along the line 6—6 of FIG. 1.

Referring now to FIGS. 2 and 6, base 12 may be molded integrally with a plurality of upstanding, hollow posts 140, 142, 146, 148, 149, 150 and 152. Post 140 is connected to handle 40 by a gusset plate 154; post 152 is connected to handle 40 by a gusset plate 156; posts 140 and 156 are connected together by a partition 158; posts 142 and 150 are connected together by a partition 160; post 149 and another post (not shown) are connected together by a partition 162 and posts 146 and 148 are connected together by a partition 164.

Shell 14 may be connected to base 12 by engaging posts 140, 142, 146, 148, 149, 150 and 152 with suitable pins, like the one shown at 166 in FIG. 6, in associated ones of the posts. Post 152 and 150 also carry a bracket, like the one shown at 168 in FIG. 2, for swingably connecting door 18 to post 152 and door 20 to post 150. Bracket 168 and partitions 160 and 162 are provided with suitable notches, like the one shown at 170 in FIG. 6, which are adapted to receive suitable trunions, like the one shown at 172 in FIG. 6, each of which extends laterally outwardly from a bracket 44 affixed to each end of garage doors 18 and 20. Each pin 172 carries a stop member 174 (FIG. 6) on its outboard end. These stop members are adapted to engage an associated post when a garage door is swung open to retain the door in a substantially horizontal position, as shown in broken lines in FIG. 6.

With the exception of spring 52 and spindle 68, which may be made of steel, the various elements of the device 10 may be molded in suitable plastic material of types well known to those skilled in the art.

As will be understood by those skilled in the art, various other arrangements may be devised without departing from the spirit and scope of the invention. It is therefore intended that the invention be limited only by the scope of the claims appended hereto.

What is claimed is:

1. A device for winding and launching a vehicle of the type which has a rotatable input coupling, comprising:

a base member;

at least two upstanding partitions on said base member for providing at least one stall for garaging said vehicle;

a shell affixed to said base member, said shell having an elevated roof portion covering said stall, and a roadway portion leading from ground level to said roof portion;

a U-shaped yoke having a bit portion and an arm extending from each end of said bite portion substantially normal thereto;

means for connecting said yoke to the upper surface of said roof portion in a manner such that said yoke will pivot about the major axis of said bite portion;

a platform member swingably connected to the free ends of said arms;

a spring biasing said platform to an elevated position;

a button connected to said yoke for lowering said platform by swinging said yoke downwardly about said bite portion;

a coupling mechanism rotatably mounted to said platform for imparting rotation to said input coupling on said vehicle;

an elongated pinion gear affixed to said coupling mechanism;

a spindle affixed to said roof for rotatably and reciprocally receiving said elongated pinion;

a first large-diameter gear drivingly engaging said elongated pinion;

a first small-diameter gear affixed to said first large-diameter gear;

a second large-diameter gear drivingly engaging said first small diameter gear;

a second small-diameter gear carried by said second large-diameter gear;

a third large-diameter gear drivingly engaging said second small-diameter gear;

an idler gear mounted to said roof portion in an arcuate slot;

a crank gear drivingly engaging said idler gear;

a crank affixed to said crank gear, said idler gear being adapted to move in said slot and engage said third large-diameter gear when said crank is rotated in a first direction and to move out of engagement with said third large-diameter gear when said crank is rotated in a direction opposite to said first direction;

a stand for covering said gears and said yoke, said stand including a first opening for said platform and a second opening for said button; and means for affixing said stand to said roof portion.

* * * * *